US009050646B2

(12) United States Patent
Fukushi et al.

(10) Patent No.: US 9,050,646 B2
(45) Date of Patent: Jun. 9, 2015

(54) AUTOMOBILE CHASSIS PART EXCELLENT IN LOW CYCLE FATIGUE CHARACTERISTICS AND METHOD OF PRODUCTION OF SAME

(75) Inventors: Takaaki Fukushi, Tokyo (JP); Hideyuki Nakamura, Tokyo (JP); Isao Anai, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 316 days.

(21) Appl. No.: 13/697,557

(22) PCT Filed: Nov. 25, 2010

(86) PCT No.: PCT/JP2010/071526

§ 371 (c)(1),
(2), (4) Date: Nov. 13, 2012

(87) PCT Pub. No.: WO2011/145234

PCT Pub. Date: Nov. 24, 2011

(65) Prior Publication Data

US 2013/0056115 A1 Mar. 7, 2013

(30) Foreign Application Priority Data

May 18, 2010 (JP) ..... 2010-114369

(51) Int. Cl.
*C22C 38/06* (2006.01)
*C21D 7/12* (2006.01)
(Continued)

(52) U.S. Cl.
CPC ..... *B21D 53/88* (2013.01); *C21D 6/005* (2013.01); *C21D 8/0226* (2013.01); *C21D 8/0263* (2013.01); *C21D 9/0068* (2013.01); *C21D 9/28* (2013.01); *C21D 2211/002* (2013.01); *C22C 38/14* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/22* (2013.01);
(Continued)

(58) Field of Classification Search
None
See application file for complete search history.

(56) References Cited

U.S. PATENT DOCUMENTS

2001/0022099 A1 9/2001 Ueno et al.
2009/0277542 A1 11/2009 Nakamura et al.
2009/0277544 A1 11/2009 Toyoda et al.

FOREIGN PATENT DOCUMENTS

JP 9-267123 10/1997
JP 2001-321846 11/2001
(Continued)

OTHER PUBLICATIONS

Machine-English translation of JP 2010-090476, Takahashi Yuzo et al., Apr. 22, 2010.*
(Continued)

*Primary Examiner* — Deborah Yee
(74) *Attorney, Agent, or Firm* — Kenyon & Kenyon LLP

(57) ABSTRACT

An automobile chassis part which is excellent in low cycle fatigue characteristics, characterized by being formed by steel which contains, by mass %, C: 0.02 to 0.10%, Si: 0.05 to 1.0%, Mn: 0.3 to 2.5%, P: 0.03% or less, S: 0.01% or less, Ti: 0.005 to 0.1%, Al: 0.005 to 0.1%, N: 0.0005 to 0.006%, and B: 0.0001 to 0.01 and has a balance of Fe and unavoidable impurities, in which 80% or more of the part structure comprises a bainite structure and in which a portion where a ratio R/t of the thickness "t" and external surface curvature radius R is 5 or less has an X-ray half width of an (211) plane of 5 (deg) or less.

4 Claims, 4 Drawing Sheets

(51) Int. Cl.

| | |
|---|---|
| ***C21D 9/08*** | (2006.01) |
| ***C22C 38/14*** | (2006.01) |
| ***C22C 38/32*** | (2006.01) |
| ***C22C 38/02*** | (2006.01) |
| ***C22C 38/04*** | (2006.01) |
| ***B21D 53/88*** | (2006.01) |
| ***C21D 6/00*** | (2006.01) |
| ***C21D 8/02*** | (2006.01) |
| ***C21D 9/00*** | (2006.01) |
| ***C21D 9/28*** | (2006.01) |
| ***C22C 38/00*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/24* (2013.01); *C22C 38/26* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01)

(56) References Cited

FOREIGN PATENT DOCUMENTS

| | | | |
|---|---|---|---|
| JP | 2008-013808 | | 1/2008 |
| JP | 2008-063656 | | 3/2008 |
| JP | 2008-095156 | | 4/2008 |
| JP | 2009-084637 | * | 4/2009 |
| JP | 2009-270142 | | 11/2009 |
| JP | 2010-090476 | * | 4/2010 |
| JP | 2010-242164 | | 10/2010 |

OTHER PUBLICATIONS

Machine-English translation of JP2009-084637, Murakami Toshio et al, Apr. 23, 2009.*

International Search Report dated Mar. 1, 2011, issued in corresponding PCT Application No. PCT/JP2010/071526.

* cited by examiner

AUTOMOBILE CHASSIS PART EXCELLENT IN LOW CYCLE FATIGUE CHARACTERISTICS AND METHOD OF PRODUCTION OF SAME

This application is a national stage application of International Application No. PCT/JP2010/071526, filed Nov. 25, 2010, which claims priority to Japanese Application No. 2010-114369, filed May 18, 2010, the content of which is incorporated by reference in its entirety.

TECHNICAL FIELD

The present invention relates to an automobile chassis part which is excellent in low cycle fatigue characteristics and a method of production of the same. As the automobile chassis part of the present invention, for example, there is an axle beam, suspension member, etc.

BACKGROUND ART

Automobile chassis parts are subjected to repeated impact load, torsional load, etc. during working of course and also during vehicle operation, so high strength and high fatigue characteristics are required. Impact load, torsional load, etc. sometimes become large loads which reach the plastic region of the material, so, in particular, the fatigue characteristics in the high stress amplitude, low cycle region (frequency of fractures of $10^5$ or less) are emphasized.

For example, regarding the automobile chassis part of an automobile axle beam, PLT 1 proposes a method of imparting fluid pressure to the inside surface of a tubular worked member (for example, steel pipe) while press-forming it and an irregular cross-section cylindrically shaped axle beam which is obtained by that method.

In this axle beam, to secure sufficient fatigue characteristics, the steel pipe is quenched, annealed, or otherwise heat treated for hardening after press-forming it so as to improve the fatigue characteristics and strength of the part to a desired level.

If performing such hardening heat treatment, the part becomes higher in cost. Furthermore, sometimes heat treatment causes the part to change in shape and makes additional correction necessary and sometimes the part softens and makes additional strengthening means (for example, treatment for surface hardening etc.) necessary.

For this reason, an automobile chassis part which has sufficient fatigue characteristics which can be produced without heat treatment after press-forming has been desired in industry.

Further, as an automobile chassis part which is excellent in fatigue characteristics, PLT 2 proposes a part which is made from steel to which Nb and Mo are added compositely. An Nb and Mo composite steel becomes harder in the surface layer by work hardening after bending. Further, there is little drop in hardness at the time of annealing for removal of internal stress performed for improvement of the fatigue characteristics, so the fatigue characteristics are excellent.

True, it is believed that if annealing after press-formation, sufficient fatigue characteristics are obtained.

However, in the state as press-formed, ferrite is present, so a large number of micro voids which become starting points for fatigue cracks after press-forming are liable to be formed. Further, with a low cycle region of fatigue, the stress amplitude becomes much greater than the yield stress of the ferrite phases, so the ferrite phases easily slide and fatigue damage locally occurs. Therefore, it cannot be believed that sufficient low cycle fatigue characteristics are obtained.

CITATIONS LIST

Patent Literature

PLT 1: Japanese Patent Publication No. 2001-321846 A1
PLT 2: Japanese Patent Publication No. 2008-63656 A1

SUMMARY OF INVENTION

Technical Problem

Automobile chassis parts which have sufficient low cycle fatigue characteristics which can be produced as press-formed without heat treatment have not been proposed up to now. In particular, in automobile chassis parts which are formed by large bending, sufficient low cycle fatigue characteristics have not been able to be obtained at portions with large bending.

Therefore, the present invention has as its object the provision of an automobile chassis part which is low in cost, does not require additional correction or additional strengthening means, and which has sufficient low cycle fatigue characteristics even if formed by large bending without heat treatment after press-forming and a method of production of the same.

Solution to Problem

The inventors studied the process of formation of micro voids and formation and progression of fatigue cracks in the steel material forming a part from around the time of shaping to the application of the fatigue load so as to obtain an automobile chassis part which has sufficient low cycle fatigue characteristics.

As a result, the inventors newly discovered that in automobile chassis parts made of steel, the micro voids which are formed at the time of production of the steel material or at the time of shaping promote the formation or progression of fatigue cracks when used as parts after being worked.

Further, the inventors newly discovered that the microstructure which is advantageous for low cycle fatigue characteristics differs depending on the value of the ratio R/t of the thickness "t" of the portions which form starting points of low cycle fatigue cracks at a part after shaping and the external surface curvature radius R.

A part which is formed mainly by bending to give a ratio R/t of the thickness "t" of a portion which forms a starting point of a low cycle fatigue crack and the external surface curvature radius R of 5 or less is compulsorily given strain in the structure as a whole of the portion where R/t is 5 or less. The inventors discovered that if making the structure of the steel a uniform structure of mainly bainite, there is little formation of micro voids after shaping and the low cycle fatigue life becomes longer, if the ratio of bainite in the structure becomes less than 80%, a large number of micro voids are formed at the boundaries of the soft structures and hard structures, the voids promote the formation and progression of fatigue cracks, and therefore the low cycle fatigue life becomes shorter.

The inventors took note of this discovery and engaged in various studies. As a result, the inventors discovered that by controlling the structure of the steel to mainly a bainite structure, forming steel pipe with sufficiently little defects, then shaping it mainly by bending, a part is obtained which has strikingly superior low cycle fatigue characteristics than a part which is produced by using steel of another structure or another shaping method.

The present invention was made based on the above discovery and has as its gist the following:

(1) An automobile chassis part which is excellent in low cycle fatigue characteristics characterized by comprising steel which contains, by mass %, C: 0.02 to 0.10%,
Si: 0.05 to 1.0%,
Mn: 0.3 to 2.5%,
P: 0.03% or less,
S: 0.01% or less,
Ti: 0.005 to 0.1%,
Al: 0.005 to 0.1%,
N: 0.0005 to 0.006%, and
B: 0.0001 to 0.01 and has a balance of Fe and unavoidable impurities, the automobile chassis part which is excellent in low cycle fatigue characteristic characterized in that 80% or more of the part structure is a bainite structure and in that a portion which has a ratio R/t of the thickness "t" and external surface curvature radius R of 5 or less has an X-ray half width of an (211) plane of 5 (deg) or less.

(2) An automobile chassis part which is excellent in low cycle fatigue characteristics as set forth in (1), characterized in that the steel which forms the automobile chassis part further contains, by mass %, one or more elements which are selected from Cu: 0.005 to 1.0%,
Ni: 0.005 to 1.0%,
Cr: 0.03 to 1.0%,
Mo: 0.1 to 0.5%,
Nb: 0.003 to 0.2%,
V: 0.001 to 0.2%,
W: 0.001 to 0.1%,
Ca: 0.0001 to 0.02%,
Mg: 0.0001 to 0.02%,
Zr: 0.0001 to 0.02%, and
REM: 0.0001 to 0.02%.

(3) A method of production of an automobile chassis part which is excellent in low cycle fatigue characteristics comprising heating a steel slab which contains, by mass %, C: 0.02 to 0.10%,
Si: 0.05 to 1.0%,
Mn: 0.3 to 2.5%,
P: 0.03% or less,
S: 0.01% or less,
Ti: 0.005 to 0.1%,
Al: 0.005 to 0.1%,
N: 0.0005 to 0.006%, and
B: 0.0001 to 0.01% and has a balance of Fe and unavoidable impurities, to 1070° C. to 1300° C., then hot rolling by a finish rolling end temperature of 850° C. to 1070° C., then cooling by a cooling speed V (° C./sec) which satisfies formula (A) down to 500° C. or less, then forming a pipe so that a pipemaking strain $\Delta\epsilon$ of an outermost surface of the steel material in a breakdown process becomes a range of the following formula (B) at the time of an outside diameter D and a thickness "t", then press-forming the pipe:

$$300/M \leq V \leq 3000/M \quad (A)$$

$$0.7t/(D-t) \leq \Delta\epsilon \leq 1.2t/(D-t) \quad (B)$$

where, $$M = \exp\{6.2(C+0.27Mn+0.2Cr+0.05Cu+0.11Ni+0.25Mo)+0.74\} \quad (C)$$

the values of C, Mn, Cr, Cu, Ni, and Mo of formula (C) are mass %.

A method of production of an automobile chassis part which is excellent in low cycle fatigue characteristics as set forth in (3), characterized in that the steel slab further contains, by mass %, one or more elements which are selected from Cu: 0.005 to 1.0%,
Ni: 0.005 to 1.0%,
Cr: 0.03 to 1.0%,
Mo: 0.1 to 0.5%,
Nb: 0.003 to 0.2%,
V: 0.001 to 0.2%,
W: 0.001 to 0.1%,
Ca: 0.0001 to 0.02%,
Mg: 0.0001 to 0.02%,
Zr: 0.0001 to 0.02%, and
REM: 0.0001 to 0.02%.

Advantageous Effects of Invention

The automobile chassis part of the present invention is mainly shaped by bending. Further, the structure is a uniform one mainly comprised of bainite, so is resistant to formation of micro voids at the time of shaping. As a result, the formation of cracks due to micro voids is suppressed. Furthermore, the progression of cracks comprised of such micro voids connected together can be suppressed, so the automobile chassis part of the present invention is excellent in low cycle fatigue characteristics.

The greater the amount of shaping strain, the more remarkable this trend. The difference between the automobile chassis part of the present invention and conventional automobile chassis parts in low cycle fatigue life becomes larger.

Further, the automobile chassis part of the present invention keeps formation of micro voids to the minimum even in the process of production of the steel material and process of formation of a pipe. That is, by satisfying the conditions of the above formula (B), pipemaking strain, which forms the starting point of a fatigue crack which occurs in the break down (below, referred to as "BD") process, where large strain enters the surface-most layer of the steel material, is suppressed.

Therefore, the automobile chassis part of the present invention has less dislocations, voids, and other defects at a portion which forms the starting point of a fatigue crack of products, so exhibits excellent low cycle fatigue characteristics.

Further, the automobile chassis part of the present invention has a uniform structure mainly comprised of bainite, so the fatigue damage does not become localized. Furthermore, for high stress amplitude in the low cycle fatigue region, compared with a structure of the same strength level mainly comprised of ferrite phases such as DP steel, the yield stress becomes high, the slip resistance to dislocations becomes high with respect to repeated stress, and formation of fatigue cracks can be further suppressed.

The automobile chassis part of the present invention has far better low cycle fatigue characteristics than automobile chassis parts which are produced by other structures or by other methods of production, so hardening after shaping, increase of strength, and other heat treatment can be omitted.

Due to omission of the heat treatment, the heat treatment cost can be eliminated. Further, deposition of oxide scale at the time of heat treatment can be prevented, so the quality of appearance of the part is not impaired, changes in shape due to heat treatment can be prevented, and there are other advantages.

DESCRIPTION OF EMBODIMENTS

The reasons for limitation of the structure of the steel which forms the part of the present invention will be explained below.

Figure 1:
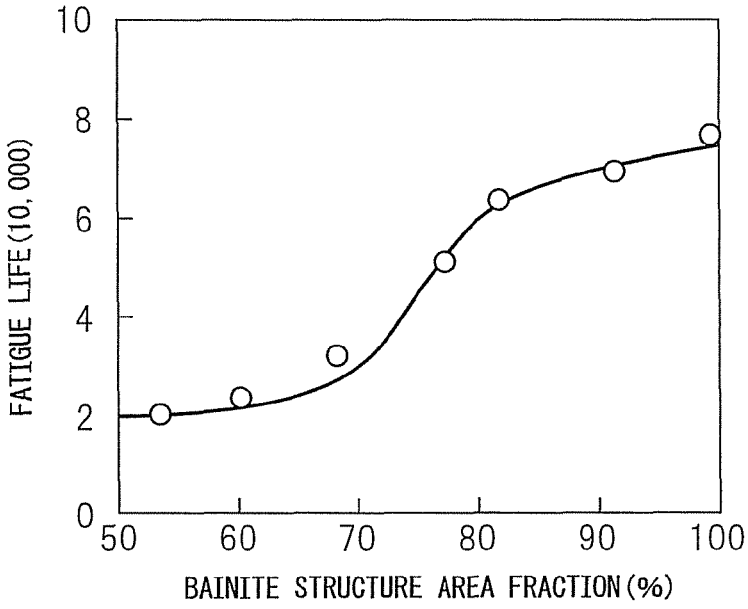
FIG. 1 is a view which shows the relationship between the area fraction of bainite structures and the low cycle fatigue characteristics.

FIG. 1 shows the relationship between the bainite fraction and low cycle fatigue characteristics of the steel which forms the part.

The low cycle fatigue characteristics differ according to the level of strength, so here they will be represented by the number of repeated applications until a crack forms when running a torsional fatigue test on a part with a stress amplitude/TS applied to the portion forming a crack of 0.8 (below, referred to as "fatigue life").

FIG. 1 shows the results of a low cycle fatigue test on parts obtained using the steel which was used for Invention Example 1 of the examples while changing the cooling speed and changing the area fraction of the bainite.

As shown in FIG. 1, the low cycle fatigue characteristics are improved along with the increase in the area fraction of bainite. The value becomes extremely high and substantially stable at an area fraction of bainite of 80%.

If phases softer than bainite are excessively present, micro voids and fatigue cracks easily form at the soft phases. Further, if phases harder than bainite are excessively present at the surface layer of the steel, micro voids and fatigue cracks easily form at the interfaces of the hard phases and bainite phases or near their interfaces.

As phases softer than bainite, there are ferrite, pearlite, stable residual austenite, etc., while as phases harder than bainite, there are martensite, unstable residual austenite which produces work-induced martensite, etc.

In the steel which forms the automobile chassis part of the present invention, the area fraction of the bainite structure is preferably close to 100% and may even be 100%. The effects of the present invention can be sufficiently obtained even if the remaining structure comprises one or more of ferrite, pearlite, martensite, and residual austenite in a total of up to 20%.

Therefore, the steel which forms the automobile chassis part of the present invention has a bainite fraction of 80% or more.

The starting point of a low cycle fatigue crack and low cycle fatigue characteristics will be explained in detail next.

Here, the low cycle fatigue characteristics are represented by the fatigue life at the time of running a torsional fatigue test on a part with a stress amplitude/TS applied to a portion where a crack occurs of 0.8.

The portion where a crack occurs differs depending on the part, but when applying fatigue stress, generally the vertex part where bending is applied becomes the portion where a crack occurs.

Figure 4:
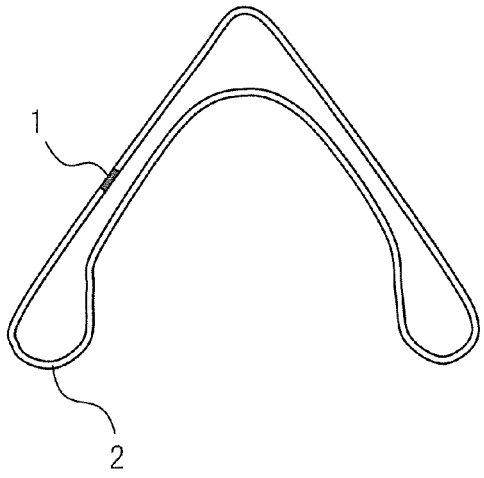
FIG. 4 is a view which shows the cross-sectional shape of an automobile chassis part in an embodiment.

FIG. 4 shows the cross-sectional shape of an axle beam which is produced by a method similar to the method of production which is shown in PLT 1. When this part was used to run a low cycle fatigue test by the method which is shown in the examples of the present invention, the portion where a crack occurs became the portion 2 where a crack occurs of FIG. 4 (below, also referred to as "edge").

There are two reasons why the edge becomes the portion where a crack occurs at this part.

The first is that extreme bending with a small R/t is performed, so a large number of micro voids which form starting points of fatigue cracks are formed at the edge.

The second is that the edge becomes the largest in amplitude at the time of running a torsional fatigue test. Further, the R of the edge is small, so it is believed that the concentration of the load stress becomes large and the stress applied to the edge becomes large.

Figure 2:
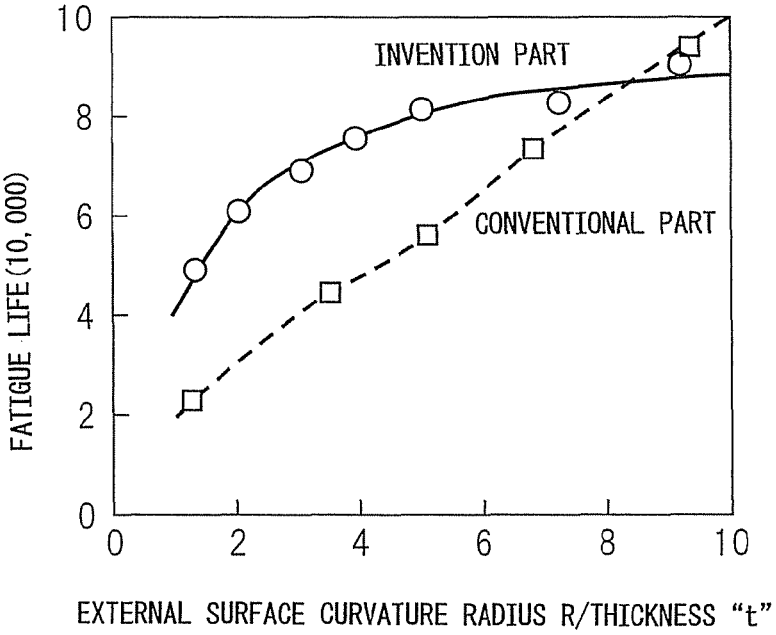
FIG. 2 is a view which shows the relationship between the ratio R/t of the thickness "t" of a portion becoming the starting point of a low cycle fatigue crack and the external surface curvature radius R and the low cycle fatigue characteristics.

As explained above, in the automobile chassis part of the present invention, even when extremely bending by a small R/t, there is little formation of voids and the low cycle fatigue characteristics are excellent. FIG. 2 shows the effects.

FIG. 2 shows the results of running a low cycle fatigue test on parts obtained by using the steel which was used for Invention Example 1 of Example 1 while changing the shaping die to change the R/t.

In the part of the present invention, the low cycle fatigue characteristics are not greatly superior to the conventional parts in the region of a large R/t, but in the region of a small R/t, in particular when R/t≤5, an extremely superior fatigue life is exhibited compared with conventional parts.

That is, in the present invention, even with large bending of an R/t of 5 or less, formation of voids is suppressed compared with conventional parts and a part which is superior in low cycle fatigue characteristics can be obtained.

The area fraction of the bainite structure is found by burying and polishing a cross-section of a plate, then corroding it by a 3% Nital solution, observing the microstructure of the steel by an optical microscope at a power of 400× for 10 fields, and quantifying the area rate of the bainite parts.

Here, the low cycle fatigue characteristics were evaluated by the fatigue life when simulating the stress which is applied at the time of actual vehicle operation and performing a fatigue test which twists the part as a whole. The frequency of the fatigue test was 1 Hz and the stress conditions were complete reversed bending. The criteria for judgment as being "good" was made a fatigue life of 60,000 cycles.

Next, the composition of ingredients of the steel which is used in the automobile chassis part of the present invention will be explained.

C is made 0.02% or more to obtain the level of strength which is required by steel plate (for example, 590 MPa class, 690 MPa class, 780 MPa class, 865 MPa class, and 980 MPa class).

If the content of C exceeds 0.10%, the number of carbide particles in the bainite increases, so at the time of shaping, micro voids easily form at the interface of the carbides. Further, the toughness falls, so sufficient fatigue characteristic cannot be obtained. Furthermore, the strength becomes too high, so shapeability cannot be secured. At the time of welding the part, sometimes delayed fracture cracks occur.

Therefore, the content of C is made 0.02 to 0.10%.

Si is included in an amount of 0.05% or more as a deoxidizing element for suppressing coarse oxides which impair the fatigue characteristics and workability. If the content of Si is over 1.0%, $SiO_2$ and other inclusions are formed and micro voids are easily formed at the time of shaping.

Therefore, the content of Si is made 0.05 to 1.0%.

Mn is effective for securing quenchability and obtaining a bainite structure. To obtain this effect, addition of 0.3% or more is necessary. If the content of Mn is over 2.5%, the formation of defects due to $MnO_2$ and the center segregation due to MnS become remarkable.

Therefore, the content of Mn is made 0.3 to 2.5%.

P concentrates at the crystal grain boundaries. If the content is over 0.03%, the fatigue strength of the grain boundaries sometimes is lowered.

Therefore, the content of P is restricted to 0.03% or less.

If the content of S is over 0.01%, sometimes coarse MnS is formed and the fatigue characteristics and shapeability are impaired.

Therefore, the content of S is restricted to 0.01% or less.

Ti is effective for immobilizing N as TiN and securing the quenchability of B. To obtain this advantageous effect, 0.005% or more has to be added. If the content of Ti is over 0.1%, coarse TiN is produced and micro voids are easily formed.

Therefore, the content of Ti is made 0.005 to 0.1%.

Al and N are elements which form AlN to promote the refinement of the bainite structure and improve the fatigue characteristics. If the content of Al is less than 0.005% or the content of N is less than 0.0005%, the effect is insufficient. If the content of Al is over 0.1% or the content of N is over 0.006%, the cleanliness of the steel falls. Furthermore, sometimes coarse AlN is formed and the fatigue characteristics and shapeability fall.

Therefore, the content of Al is made 0.005 to 0.1%, while the content of N is made 0.0005 to 0.006%.

B is an element which improves the quenchability of steel and is extremely effective for obtaining a bainite structure. If the content of B is less than 0.0001%, the advantageous effect cannot be sufficiently obtained. If the content of B is over 0.01%, coarse borides (borocarbides, boronitrides, borocarbonitrides, etc.) are easily formed and the quenchability is impaired. Further, they easily form starting points of cracks or starting points of micro voids at the time of bending or at the time of application of a fatigue load.

Therefore, the content of B is made 0.0001 to 0.01%.

In addition to the above elements, furthermore, as optional elements, the elements which are shown below may also be added:

I. Group of elements promoting formation of bainite:
- Cu: 0.005 to 1.0%,
- Ni: 0.005 to 1.0%,
- Cr: 0.03 to 1.0%,
- Mo: 0.1 to 0.5%.

II. Group of elements refining crystals:
- Nb: 0.003 to 0.2%,
- V: 0.001 to 0.2%,
- W: 0.001 to 0.1%.

III. Group of elements controlling form of inclusions:
- Ca: 0.0001 to 0.02%,
- Mg: 0.0001 to 0.02%,
- Zr: 0.0001 to 0.02%,
- REM: 0.0001 to 0.02%.

It is possible to select and add one group among these three groups or select and add two or more groups. Further, it is possible to add just one type of element among the elements which are contained in a selected group or add two or more types.

Cu, Ni, Cr, and Mo of the group of elements which promote the formation of bainite are all effective for improving the quenchability and forming a bainite structure.

When the contents of Cu, Ni, Cr, and Mo are respectively less than 0.005%, less than 0.005%, less than 0.03%, and less than 0.1%, it is difficult to sufficiently obtain the actions of the elements in promoting the formation of bainite.

When Cu, Ni, Cr, and Mo respectively exceed 1.0%, 1.0%, 1.0%, and 0.5%, a large amount of hard phases are easily formed, so it is difficult to make the fraction of the bainite structure 80% or more.

Therefore, when adding Cu, Ni, Cr, and/or Mo, the contents are made Cu: 0.005 to 1.0%, Ni: 0.005 to 1.0%, Cr: 0.03 to 1.0%, and Mo: 0.1 to 0.5%.

The Nb, V, and W of the group of refining elements are all effective for refining the bainite structure and fatigue characteristics and improving the shapeability.

To obtain this effect, Nb has to be added in 0.003% or more, V in 0.001% or more, and W in 0.001% or more. Further, if Nb exceeds 0.2%, V exceeds 0.2%, and W exceeds 0.1%, coarse carbides are easily formed in the steel, so at the time of shaping, micro voids easily form at the interface of the carbides and the low cycle fatigue characteristics fall.

Therefore, when adding Nb, V, and/or W, the contents are made Nb: 0.003 to 0.2%, V: 0.001 to 0.2%, and W: 0.001 to 0.1%.

Ca, Mg, Zr, and REM of the group of elements which control the form of inclusions all have the action of controlling the form of the sulfides and raising the shapeability.

To obtain this effect, Ca has to be added in 0.0001% or more, Mg in 0.0001% or more, Zr in 0.0001% or more, and REM in 0.0001% or more. If the contents of these elements exceed 0.02%, coarse sulfides of these elements and composite compounds with clustered oxides are formed and micro voids are more easily formed.

Therefore, when adding Ca, Mg, Zr, and/or REM, the contents are made Ca: 0.0001 to 0.02%, Mg: 0.0001 to 0.02%, Zr: 0.0001 to 0.02%, and REM: 0.0001 to 0.02%.

Next, the method of production of the automobile chassis part of the present invention will be explained.

First, a steel slab which has the above-mentioned combination of ingredients is heated to 1070° C. to 1300° C., then hot rolling is performed while making the finish rolling end temperature 850° C. to 1070° C. Due to this, a bainite structure which is excellent in fatigue characteristic is obtained.

If heating the steel slab to 1070° C. or more, it is possible to make the carbides, nitrides, and carbonitrides which precipitated in the process of solidification of the molten steel form solid solutions in the steel and thereby finely disperse carbides in the bainite and possible to suppress the formation of micro voids at the time of shaping.

If heating the steel slab to over 1300° C., AlN sometimes coarsely precipitates in the hot rolling process or the cooling process after rolling and forms borides (borocarbides, boronitrides, and borocarbonitrides) which impair the effect of improvement of quenchability of B.

Therefore, the heating temperature of the steel slab is made 1070° C. to 1300° C.

The finish rolling in hot rolling is performed at an austenite single phase and a temperature region of the recrystallization region of 850° C. or more so as to cause the formation of a large amount of fine bainite. If the finish rolling temperature exceeds 1070° C., the bainite structure becomes coarser and the low cycle fatigue characteristics fall.

Therefore, the finish rolling temperature in the hot rolling is made 850° C. to 1070° C.

After this, the hot rolled steel plate can be cooled from the finish rolling end temperature by the cooling speed V (° C./s) of the following formula (A) down to 500° C. or less so as to effectively cause the formation of a bainite structure.

$$300/M \leq V \leq 3000/M \quad \text{(A)}$$

where, $$M = \exp\{6.2(C+0.27Mn+0.2Cr+0.05Cu+0.11Ni+0.25Mo)+0.74\} \quad \text{(C)}$$

The values of C, Mn, Cr, Cu, Ni, and Mo in the formula (C) are mass %.

Figure 3:
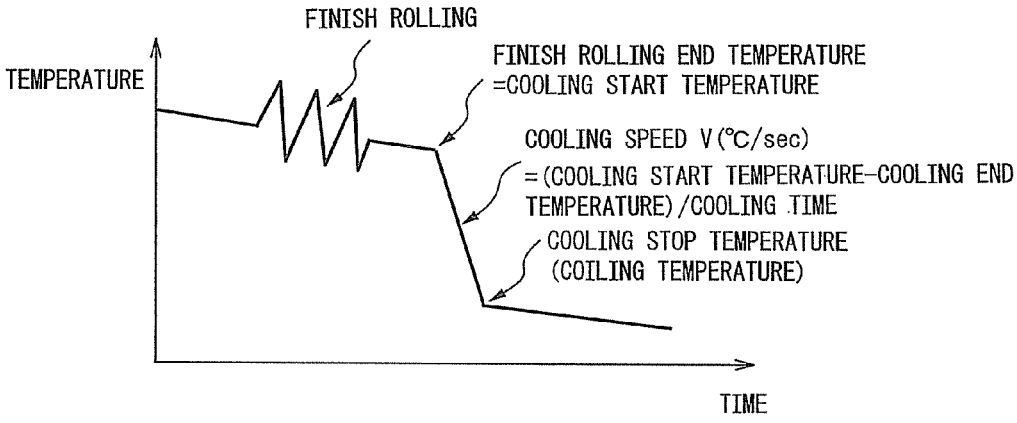
FIG. 3 is a view which schematically shows the definitions of the temperature and cooling speed at the time of hot rolling and cooling.

FIG. 3 shows the definitions of the temperature and cooling speed.

If the cooling start temperature becomes less than 850° C., sometimes a ferrite structure appears and the bainite area fraction becomes less than 80%, so the cooling start temperature is preferably 850° C. or more. Further, the finish rolling end temperature becomes 1070° C. or less, so the cooling start temperature inevitably becomes 1070° C. or less.

If the cooling speed V (° C./s) is larger than the range determined by the above formula (A), the area fraction of hard martensite remarkably increases compared with bainite, the area fraction of the bainite structure does not become 80% or more, and as a result micro voids are formed at the time of shaping and further fatigue damage becomes localized, so sufficient low cycle fatigue characteristics cannot be obtained.

If the cooling speed V (° C./s) is smaller than the range of the above formula (A), the formation of soft ferrite and pearlite remarkably increases compared with bainite, the area fraction of the bainite structure does not become 80% or more, and as a result micro voids are formed at the time of shaping and the fatigue damage becomes localized, so sufficient low cycle fatigue characteristics cannot be obtained.

Figure 5:
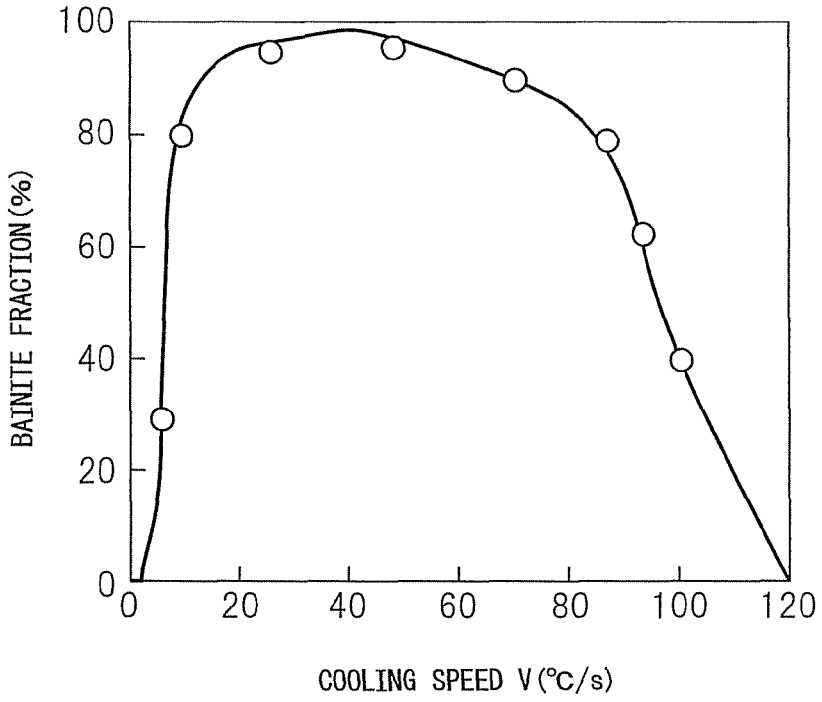
FIG. 5 is a view which shows the relationship between the formula (A) and the bainite fraction.

FIG. 5 shows the relationship between the formula (A) in the case of using the steel which was used in Invention Example 1 of the examples and the bainite fraction. The abscissa indicates the cooling speed, while the ordinate indicates the bainite fraction.

From FIG. 5, it will be understood that if V becomes outside the range of the formula (A), the bainite fraction becomes less than 80%. As clear from FIG. 1, if the bainite fraction becomes less than 80%, sufficient low cycle fatigue characteristics cannot be obtained.

Even if the cooling speed V is within the range of the present invention, if the cooling stop temperature exceeds 500° C., the fractions of ferrite and pearlite increase and the fraction of bainite becomes less than 80%.

Therefore, in the production of the steel plate which is used for the automobile chassis part of the present invention, the steel plate is cooled down to 500° C. by a cooling speed V which satisfies the above formula (A). The cooling is preferably cooled while cooling the cooling speed.

Even if stopping the cooling at ordinary temperature to a temperature of within 500° C. and holding the hot rolled steel plate at a 500° C. or less temperature region (for example, stacking coiled hot rolled steel plate etc.), the present invention is not departed from. Further, even if simple heat treatment which raises the temperature of the surface layer of the steel plate in the 500° C. or lower temperature region is added to the process of production of a steel material or automobile chassis part for the purpose of touching up the surface or removing residual stress, the present invention is not departed from.

The method of producing electric resistance welded steel pipe for automobile chassis part use from the obtained hot rolled steel plate will be explained.

The electric resistance welded steel pipe is formed by rolls. This is divided into a BD process mainly comprised of bending and a fine pass (below, referred to as "FP") process mainly comprised of drawing. The process which greatly affects the low cycle fatigue characteristics of a part is the BD process which introduces a large bending strain into the outermost surface of the steel material which forms the starting point of a fatigue crack.

To obtain a part which has sufficient low cycle fatigue characteristics, the pipe has to be made so that the pipemaking strain $\Delta\epsilon$ of the outermost surface of the steel material which is introduced by the BD process becomes the following formula (B) in range:

$$0.7t/(D-t) \leq \Delta\epsilon \leq 1.2t/(D-t) \quad \text{(B)}$$

If $\Delta\epsilon$ is larger than the range which is determined by the above formula (B), it means that a large plastic strain is introduced due to bending and unbending in the long direction or peripheral direction and a large number of voids are formed, so the low cycle fatigue characteristics deteriorate. In this case, the X-ray half width of the (211) plane of a portion which becomes the starting point of low cycle fatigue cracks of a part after shaping becomes larger.

If $\Delta\epsilon$ is smaller than the range which is determined by the above formula (B), the bending is insufficient and obtaining steel pipe by the subsequent processes becomes difficult.

Figure 6:
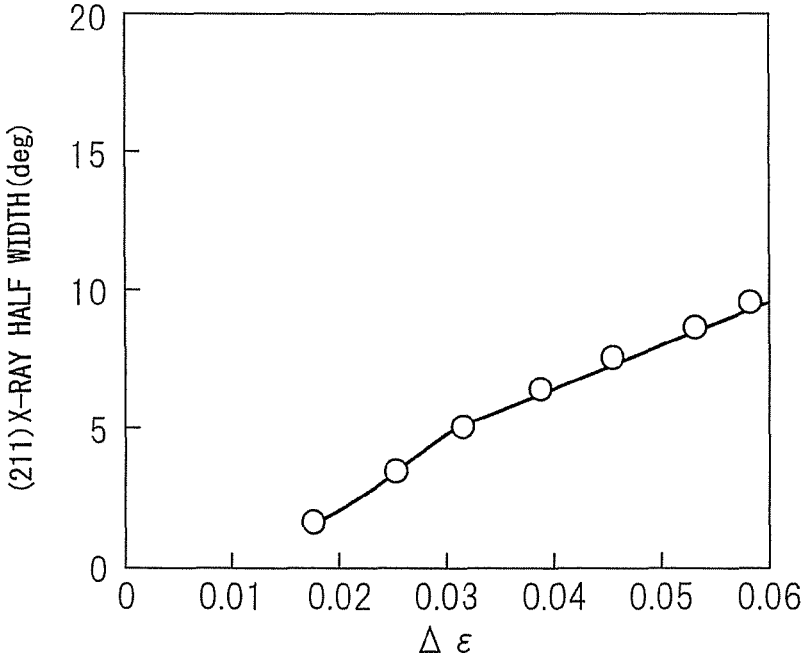
FIG. 6 is a view which shows the relationship between the formula (B) and the value of the X-ray half width.

FIG. 6 shows the relationship between the formula (B) and the X-ray half width of the (211) plane in the case of producing a product by using the steel plate which was used in Invention Example 1 of the examples and changing the $\Delta\epsilon$.

If $\Delta\epsilon$ is smaller than the range which is determined by the above formula (B), the bending is insufficient and a steel pipe cannot be formed in the later processes, so the X-ray half width is not measured.

If $\Delta\epsilon$ is larger than the range which is determined by the above formula (B), the value of the X-ray half width is over 5. As explained later, when the value of the X-ray half width exceeds 5, it means there are a large number of dislocations, voids, etc. present which can become starting points of fatigue cracks, so sufficient low cycle fatigue characteristics cannot be expected.

Here, the method of finding $\Delta\epsilon$ will be explained.

The position of measurement of $\Delta\epsilon$ has to correspond to a portion where cracks easily occur due to low cycle fatigue in the part. The portion where cracks easily occur due to low cycle fatigue can be found by analyzing the rigidity by FEM in advance.

In the case of the examples of the present invention, the electric resistance weld zone 1 and the portion 2 where cracks easily form are in the positional relationship which are shown in FIG. 4 and are separated by 41 mm. In this case, samples of the steel plate before BD and the steel plate after BD were taken and the $\Delta\epsilon$ was measured at positions 41 mm from the plate edges.

First, the steel plate was buried and polished at the plate cross-section, then the hardness of the outermost surface was measured by micro-Vicker's hardness at a load of 100 gf. Next, a tensile test was run on a hot rolled steel plate before pipemaking, the test was stopped at various amounts of stain, the test piece was measured for hardness, and the strain-hardness relationship was measured. Further, the values of hardness before BD and after BD were converted to strain and the difference in amounts of strain was defined as $\Delta\epsilon$.

Specifically, as the method of reducing the $\Delta\epsilon$, there is the method of reducing the radius of curvature of the roll caliber of the BD and reducing the amount of bending in the peripheral direction or the method of increasing the roll diameter in the longitudinal direction and reducing the amount of bending-unbending in the longitudinal direction.

Next, the reasons for limitation of the value of the X-ray half width in the automobile chassis part of the present invention will be explained.

The inventors investigated the relationship between the value of the X-ray half width of a portion which easily cracks due to low cycle fatigue and the low cycle fatigue characteristics of auto parts which are produced by various methods of production. As a result, they discovered that there is a clear correlation between the value of the X-ray half width of a portion which easily cracks due to low cycle fatigue and the low cycle fatigue characteristics.

Figure 7:
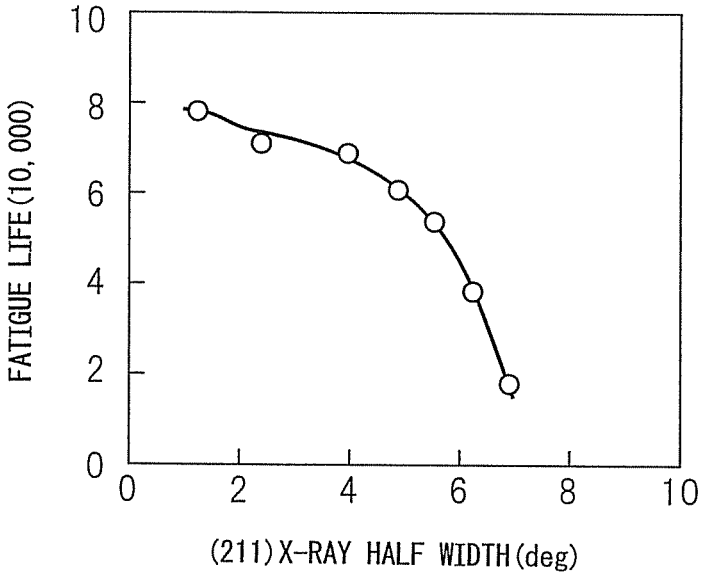
FIG. 7 is a view which shows the relationship the value of the X-ray half width and the low cycle fatigue characteristics.

FIG. 7 shows the relationship between the value of the X-ray half width and the low cycle fatigue characteristics.

The X-ray half width was measured using an X-ray stress analyzer Model PSPC-MSF made by Rigaku. The measurement was performed under the following measurement conditions.

Target: Cr—K$\alpha$/V filter

Tube voltage/tube current: 40 kV/30 mA

Counter: position sensitive type proportional counter tube

Collimator: 0.5 mm$\phi$

Diffraction plane, interplanar distance: (211), d=1.1702 Å

X-rays are used for measurement, so the obtained information becomes information near the surface layer of the plate thickness at the measured portion.

The reason for performing the measurement at the (211) plane is that measurement of even a portion which is curved such as in FIG. 4 can be measured and the peak strength is high, so the reliability of the half width value is high.

From FIG. 7, it is learned that with an X-ray half width of 5 or less, the low cycle fatigue characteristic is stable at an extremely high value, but if the X-ray half width is over 5, the low cycle fatigue characteristics rapidly fall.

The inventors investigated the cause for this by cutting out a portion forming the starting point of fatigue cracks at the part after measurement by X-rays and observing it under an SEM. As a result, when the X-ray half width is 5 or less, there were scattered micro voids, but when the X-ray half width exceeds 5, a large number of micro voids were seen. Further, micro voids combined and grew resulting in several groups of voids being seen.

The inventors postulated that these voids were the direct cause of formation of fatigue cracks and engaged in various studies. As a result, they discovered that by combining structures resistant to formation of voids, pipeforming methods resistant to formation of voids, and shaping conditions resistant to formation of voids, the low cycle fatigue characteristics become strikingly superior.

That is, the low cycle fatigue characteristics can be found from the composition of ingredients and structure of the steel and the X-ray half width of the part.

It is important that the composition of ingredients of the steel be made the composition of ingredients which is defined in the present invention and that the steel be produced by the hot rolling conditions defined in the present invention in order to obtain a uniform mainly bainite structure.

The X-ray half width of a part is determined by the total of the structure, pipemaking conditions, and shaping conditions of the part. By the structure being uniform and mainly bainite, the pipemaking conditions being conditions which are shown in formula (B), and the amount of strain in the BD process being kept to the minimum, even with shaping mainly comprised of bending, the formation of voids can be kept to a minimum and the X-ray half width of the (211) plane becomes 5 or less. That is, the part becomes one with few micro voids and superior low cycle fatigue characteristics.

Note that, the portions which easily crack due to low cycle fatigue are generally portions where the ratio R/t of the thickness "t" and external surface curvature radius R is 5 or less, so in the automobile chassis part of the present invention, the portion with an R/t of 5 or less is defined as having an X-ray half width of the (211) plane of 5 or less.

Further, the portions which easily crack due to low cycle fatigue can be found by analyzing the rigidity by FEM in advance. If the X-ray half width of the (211) plane of the portion found is 5 or less, even if another portion where R/t is 5 or less, it can be judged that the X-ray half width of the (211) plane is 5 or less.

Further, it is also possible to run a torsional fatigue test on a part to identify a portion which actually cracks and measure the X-ray half width of the (211) plane.

That is, the X-ray half width of the (211) plane being 5 or less even a portion which is weakest against low cycle fatigue in a part is the main gist of the art according to the present invention.

The method of production of the automobile chassis parts may be production by press-formation from the steel pipe obtained. The method of press-formation is, for example, the method such as shown in PLT 1.

To produce the automobile chassis part of the present invention, it is possible to use steel pipe which is comprised of hot rolled steel plate with a thickness of 0.7 to 20 mm (including steel strip). It is preferable to use a steel material mainly comprised of a bainite structure of a tensile strength of 590 MPa class, 685 MPa class, 780 MPa class, 865 MPa class, and 980 MPa class.

Further, the method of press-formation is not limited, but if using the method of sealing a fluid into a steel pipe and press-forming it to obtain an automobile chassis part, the part is easily shaped by mainly bending, so this is preferred.

EXAMPLES

The steel of each of the composition of ingredients of Tables 1 and 2 was made into a 30 kg steel ingot in a vacuum melting furnace. The steel ingot was heated under the conditions which are shown in Tables 3 and 4, then hot rolled to a thickness of 2 mm, then cooled to obtain hot rolled steel plate.

In Tables 1 to 4, examples where the requirements of the present invention are not satisfied are underlined. In Tables 1 and 2, empty cells of optional elements indicate no addition.

TABLE 1

| | | | | | | | | | | | Group of elements promoting formation of bainite | | | |
|---|---|---|---|---|---|---|---|---|---|---|---|---|---|---|
| | | C | Si | Mn | P | S | Ti | Al | N | B | Cu | Ni | Cr | Mo |
| Inv. | 1 | 0.05 | 0.20 | 1.50 | 0.010 | 0.003 | 0.020 | 0.030 | 0.0030 | 0.0010 | | | | |
| ex. | 2 | 0.10 | 0.21 | 1.50 | 0.010 | 0.003 | 0.020 | 0.030 | 0.0030 | 0.0010 | | | | |
| | 3 | 0.05 | 0.20 | 1.49 | 0.007 | 0.002 | 0.024 | 0.077 | 0.0031 | 0.0005 | | | 0.40 | 0.30 |
| | 4 | 0.07 | 0.20 | 1.50 | 0.010 | 0.003 | 0.025 | 0.030 | 0.0030 | 0.0010 | 0.30 | 0.05 | | 0.30 |
| | 5 | 0.05 | 0.20 | 1.50 | 0.010 | 0.003 | 0.025 | 0.030 | 0.0030 | 0.0010 | 0.65 | 0.30 | 0.30 | 0.12 |
| | 6 | 0.05 | 0.20 | 1.50 | 0.010 | 0.003 | 0.020 | 0.030 | 0.0030 | 0.0005 | | | | |
| | 7 | 0.06 | 0.20 | 1.50 | 0.010 | 0.003 | 0.029 | 0.030 | 0.0058 | 0.0005 | | | | |
| | 8 | 0.05 | 0.23 | 1.50 | 0.010 | 0.008 | 0.020 | 0.030 | 0.0030 | 0.0010 | | | | |
| | 9 | 0.03 | 0.20 | 1.50 | 0.018 | 0.008 | 0.020 | 0.030 | 0.0030 | 0.0010 | | | | |
| | 10 | 0.05 | 0.20 | 1.50 | 0.010 | 0.007 | 0.020 | 0.030 | 0.0030 | 0.0010 | | | | |
| | 11 | 0.02 | 0.20 | 1.70 | 0.010 | 0.007 | 0.022 | 0.007 | 0.0030 | 0.0010 | | | | |
| | 12 | 0.06 | 0.20 | 1.50 | 0.010 | 0.008 | 0.020 | 0.030 | 0.0030 | 0.0025 | | 0.40 | | 0.20 |
| | 13 | 0.05 | 0.20 | 1.50 | 0.010 | 0.007 | 0.020 | 0.030 | 0.0044 | 0.0010 | | | 0.20 | 0.30 |
| | 14 | 0.08 | 0.20 | 1.50 | 0.010 | 0.009 | 0.020 | 0.030 | 0.0030 | 0.0010 | 0.35 | | | 0.35 |
| | 15 | 0.05 | 0.22 | 1.50 | 0.010 | 0.003 | 0.020 | 0.030 | 0.0030 | 0.0010 | | | | |
| | 16 | 0.04 | 0.20 | 1.01 | 0.025 | 0.007 | 0.038 | 0.007 | 0.0034 | 0.0010 | 0.85 | 0.17 | 0.10 | 0.50 |
| | 17 | 0.05 | 0.20 | 1.50 | 0.010 | 0.003 | 0.020 | 0.030 | 0.0030 | 0.0010 | 0.48 | | 0.20 | 0.28 |
| | 18 | 0.06 | 0.20 | 1.50 | 0.010 | 0.001 | 0.020 | 0.030 | 0.0030 | 0.0010 | 0.98 | 0.25 | 0.20 | 0.10 |
| | 19 | 0.05 | 0.20 | 1.50 | 0.010 | 0.003 | 0.020 | 0.030 | 0.0030 | 0.0010 | 0.50 | 0.20 | | |
| | 20 | 0.03 | 0.20 | 0.47 | 0.010 | 0.005 | 0.081 | 0.030 | 0.0030 | 0.0010 | | 0.95 | 0.50 | 0.30 |
| | 21 | 0.02 | 0.20 | 1.50 | 0.010 | 0.005 | 0.020 | 0.030 | 0.0030 | 0.0010 | 0.25 | 0.07 | | 0.20 |
| | 22 | 0.09 | 0.20 | 1.50 | 0.010 | 0.005 | 0.020 | 0.030 | 0.0030 | 0.0010 | | 0.45 | 0.30 | |
| | 23 | 0.05 | 0.20 | 1.50 | 0.010 | 0.003 | 0.022 | 0.030 | 0.0030 | 0.0010 | 0.12 | 0.02 | | 0.30 |
| | 24 | 0.08 | 0.20 | 1.50 | 0.010 | 0.005 | 0.020 | 0.030 | 0.0030 | 0.0010 | | | | |
| | 25 | 0.05 | 0.20 | 1.50 | 0.010 | 0.007 | 0.020 | 0.030 | 0.0030 | 0.0010 | | | | |
| | 26 | 0.07 | 0.20 | 1.03 | 0.007 | 0.002 | 0.020 | 0.044 | 0.0047 | 0.0003 | 0.98 | 0.45 | 0.24 | 0.40 |
| | 27 | 0.05 | 0.25 | 1.88 | 0.010 | 0.003 | 0.018 | 0.015 | 0.0025 | 0.0012 | 0.18 | 0.07 | 0.35 | 0.15 |
| | 28 | 0.05 | 0.20 | 2.13 | 0.010 | 0.003 | 0.020 | 0.028 | 0.0030 | 0.0010 | 0.24 | 0.05 | 0.47 | 0.10 |
| | 29 | 0.08 | 0.20 | 1.47 | 0.010 | 0.003 | 0.020 | 0.030 | 0.0030 | 0.0010 | | | | |
| | 30 | 0.05 | 0.20 | 1.50 | 0.010 | 0.003 | 0.020 | 0.030 | 0.0030 | 0.0010 | | 0.73 | 0.58 | 0.30 |
| | 31 | 0.05 | 0.20 | 1.50 | 0.010 | 0.003 | 0.020 | 0.030 | 0.0030 | 0.0010 | | | | |
| | 32 | 0.05 | 0.20 | 1.50 | 0.010 | 0.003 | 0.020 | 0.030 | 0.0030 | 0.0010 | | 0.24 | 0.31 | |
| Comp. | 1 | 0.20 | 0.20 | 1.50 | 0.010 | 0.003 | 0.020 | 0.030 | 0.0030 | 0.0010 | | | | |
| ex. | 2 | 0.05 | 1.20 | 1.50 | 0.010 | 0.003 | 0.020 | 0.030 | 0.0030 | 0.0010 | | | | |
| | 3 | 0.05 | 0.20 | 0.20 | 0.010 | 0.003 | 0.020 | 0.030 | 0.0030 | 0.0010 | | | | |
| | 4 | 0.05 | 0.20 | 1.50 | 0.040 | 0.003 | 0.020 | 0.030 | 0.0030 | 0.0010 | | | | |
| | 5 | 0.05 | 0.20 | 1.50 | 0.010 | 0.015 | 0.020 | 0.030 | 0.0030 | 0.0010 | | | | |
| | 6 | 0.05 | 0.20 | 1.50 | 0.010 | 0.003 | 0.004 | 0.030 | 0.0030 | 0.0010 | | | | |
| | 7 | 0.05 | 0.20 | 1.50 | 0.010 | 0.003 | 0.020 | 0.150 | 0.0030 | 0.0010 | | | | |
| | 8 | 0.05 | 0.20 | 1.50 | 0.010 | 0.003 | 0.020 | 0.030 | 0.0100 | 0.0010 | | | | |
| | 9 | 0.05 | 0.20 | 1.50 | 0.010 | 0.003 | 0.020 | 0.030 | 0.0030 | 0.00006 | | | | |
| | 10 | 0.05 | 0.20 | 1.50 | 0.010 | 0.003 | 0.020 | 0.030 | 0.0030 | 0.0010 | | | | |
| | 11 | 0.05 | 0.20 | 1.50 | 0.010 | 0.003 | 0.020 | 0.030 | 0.0030 | 0.0010 | | | | |
| | 12 | 0.05 | 0.20 | 1.50 | 0.010 | 0.003 | 0.020 | 0.030 | 0.0030 | 0.0010 | | | | |
| | 13 | 0.05 | 0.20 | 1.50 | 0.010 | 0.003 | 0.020 | 0.030 | 0.0030 | 0.0010 | | | | |
| | 14 | 0.05 | 0.20 | 1.50 | 0.010 | 0.003 | 0.020 | 0.030 | 0.0030 | 0.0010 | | | | |
| | 15 | 0.05 | 0.20 | 1.50 | 0.010 | 0.003 | 0.020 | 0.030 | 0.0030 | 0.0010 | | | | |
| | 16 | 0.05 | 0.20 | 1.50 | 0.010 | 0.003 | 0.020 | 0.030 | 0.0030 | 0.0010 | | | | |
| | 17 | 0.05 | 0.20 | 1.50 | 0.010 | 0.003 | 0.020 | 0.030 | 0.0030 | 0.0010 | | | | |
| | 18 | 0.05 | 0.20 | 1.50 | 0.010 | 0.003 | 0.020 | 0.030 | 0.0030 | 0.0010 | | | | |

Underlined values are outside suitable ranges

Empty cells indicate no addition

TABLE 2

(Continuation of Table 1)

| | | Group of elements refining crystal | | | Group of elements controlling form of inclusions | | | | Formula (A) | | | Formula (B) | |
|---|---|---|---|---|---|---|---|---|---|---|---|---|---|
| | | Nb | V | W | Ca | Mg | Zr | REM | V upper limit | M value | V lower limit | Δϵ upper limit | Δϵ lower limit |
| Inv. | 1 | | | | | | | | 85.2 | 35.2 | 8.5 | 0.031 | 0.018 |
| ex. | 2 | | | | | | | | 62.5 | 48.0 | 6.3 | 0.031 | 0.018 |
| | 3 | | | | | | | | 33.2 | 90.5 | 3.3 | 0.031 | 0.018 |
| | 4 | | | | | | | | 41.6 | 72.0 | 4.2 | 0.031 | 0.018 |
| | 5 | | | | | | | | 32.5 | 92.3 | 3.3 | 0.031 | 0.018 |
| | 6 | 0.035 | | | | | | | 85.2 | 35.2 | 8.5 | 0.031 | 0.018 |
| | 7 | 0.010 | 0.035 | 0.035 | | | | | 80.1 | 37.4 | 8.0 | 0.031 | 0.018 |
| | 8 | | | | 0.0025 | | | | 85.2 | 35.2 | 8.5 | 0.031 | 0.018 |

TABLE 2-continued (Continuation of Table 1)

| | | Group of elements refining crystal | | | Group of elements controlling form of inclusions | | | | Formula (A) | | | Formula (B) | |
|---|---|---|---|---|---|---|---|---|---|---|---|---|---|
| | | Nb | V | W | Ca | Mg | Zr | REM | V upper limit | M value | V lower limit | Δϵ upper limit | Δϵ lower limit |
| | 9 | | | | | 0.0022 | 0.0150 | | 96.5 | 31.1 | 9.6 | 0.031 | 0.018 |
| | 10 | | | | 0.0010 | 0.0020 | | 0.0020 | 85.2 | 35.2 | 8.5 | 0.031 | 0.018 |
| | 11 | | | | 0.0018 | 0.0078 | 0.0095 | 0.0007 | 73.4 | 40.8 | 7.3 | 0.031 | 0.018 |
| | 12 | | | | | | | 0.0015 | 44.7 | 67.1 | 4.5 | 0.031 | 0.018 |
| | 13 | 0.020 | 0.020 | 0.020 | | | | | 41.8 | 71.8 | 4.2 | 0.031 | 0.018 |
| | 14 | 0.030 | | | | 0.0047 | | | 36.9 | 81.3 | 3.7 | 0.031 | 0.018 |
| | 15 | | 0.070 | 0.088 | | | 0.0040 | 0.0060 | 85.2 | 35.2 | 8.5 | 0.031 | 0.018 |
| | 16 | 0.018 | | | | 0.0138 | 0.0021 | | 57.4 | 52.3 | 5.7 | 0.031 | 0.018 |
| | 17 | | 0.045 | 0.040 | | | | | 37.1 | 80.8 | 3.7 | 0.031 | 0.018 |
| | 18 | 0.007 | | | | | | | 33.3 | 90.0 | 3.3 | 0.031 | 0.018 |
| | 19 | 0.035 | 0.014 | 0.014 | | | | | 63.7 | 47.1 | 6.4 | 0.031 | 0.018 |
| | 20 | | 0.030 | 0.033 | 0.0060 | | 0.0017 | | 95.6 | 31.4 | 9.6 | 0.031 | 0.018 |
| | 21 | 0.015 | 0.021 | 0.021 | 0.0031 | 0.0054 | | 0.0018 | 66.4 | 45.2 | 6.6 | 0.031 | 0.018 |
| | 22 | 0.005 | 0.007 | 0.001 | | | | 0.0040 | 33.7 | 88.9 | 3.4 | 0.031 | 0.018 |
| | 23 | 0.020 | 0.025 | 0.021 | 0.0015 | 0.0023 | 0.0030 | 0.0018 | 50.9 | 59.0 | 5.1 | 0.031 | 0.018 |
| | 24 | 0.037 | | | 0.0022 | | | | 70.8 | 42.4 | 7.1 | 0.031 | 0.018 |
| | 25 | 0.011 | 0.087 | 0.084 | 0.0007 | 0.0022 | 0.0018 | 0.0007 | 85.2 | 35.2 | 8.5 | 0.031 | 0.018 |
| | 26 | | | | 0.0025 | | 0.0038 | | 35.9 | 83.6 | 3.6 | 0.031 | 0.018 |
| | 27 | | | | | 0.0033 | | | 20.9 | 143.6 | 2.1 | 0.031 | 0.018 |
| | 28 | | | | 0.0013 | 0.0041 | 0.0077 | 0.0014 | 12.7 | 235.5 | 1.3 | 0.031 | 0.018 |
| | 29 | 0.005 | 0.037 | 0.030 | | | | | 74.4 | 40.3 | 7.4 | 0.031 | 0.018 |
| | 30 | | 0.039 | 0.039 | | | | | 15.9 | 189.2 | 1.6 | 0.031 | 0.018 |
| | 31 | | | | | | | | 85.2 | 35.2 | 8.5 | 0.041 | 0.024 |
| | 32 | | 0.470 | | | 0.0049 | 0.0030 | | 49.3 | 60.9 | 4.9 | 0.041 | 0.024 |
| Comp. | 1 | | | | | | | | 33.6 | 89.2 | 3.4 | 0.031 | 0.018 |
| ex. | 2 | | | | | | | | 85.2 | 35.2 | 8.5 | 0.031 | 0.018 |
| | 3 | | | | | | | | 751.1 | 4.0 | 75.1 | 0.031 | 0.018 |
| | 4 | | | | | | | | 85.2 | 35.2 | 8.5 | 0.031 | 0.018 |
| | 5 | | | | | | | | 85.2 | 35.2 | 8.5 | 0.031 | 0.018 |
| | 6 | | | | | | | | 85.2 | 35.2 | 8.5 | 0.031 | 0.018 |
| | 7 | | | | | | | | 85.2 | 35.2 | 8.5 | 0.031 | 0.018 |
| | 8 | | | | | | | | 85.2 | 35.2 | 8.5 | 0.031 | 0.018 |
| | 9 | | | | | | | | 85.2 | 35.2 | 8.5 | 0.031 | 0.018 |
| | 10 | | | | | | | | 85.2 | 35.2 | 8.5 | 0.031 | 0.018 |
| | 11 | | | | | | | | 85.2 | 35.2 | 8.5 | 0.031 | 0.018 |
| | 12 | | | | | | | | 85.2 | 35.2 | 8.5 | 0.031 | 0.018 |
| | 13 | | | | | | | | 85.2 | 35.2 | 8.5 | 0.031 | 0.018 |
| | 14 | | | | | | | | 85.2 | 35.2 | 8.5 | 0.031 | 0.018 |
| | 15 | | | | | | | | 85.2 | 35.2 | 8.5 | 0.031 | 0.018 |
| | 16 | | | | | | | | 85.2 | 35.2 | 8.5 | 0.031 | 0.018 |
| | 17 | | | | | | | | 85.2 | 35.2 | 8.5 | 0.031 | 0.018 |
| | 18 | | | | | | | | 85.2 | 35.2 | 8.5 | 0.031 | 0.018 |

Empty cells indicate no addition

TABLE 3

| | No | Heating temp. (° C.) | Finish rolling end temp. (° C.) | Cooling speed V (° C./sec) | Cooling end temp. (° C.) | Δϵ | Bainite area fraction (%) | Residual structure | Outer surface curvature radius R/ thickness t | (211) plane X-ray half width | Low cycle fatigue life (10,000) |
|---|---|---|---|---|---|---|---|---|---|---|---|
| Inv. | 1 | 1200 | 900 | 45.0 | 100 | 0.022 | 95 | Ferrite | 3 | 2.1 | 7.5 |
| ex. | 2 | 1200 | 900 | 8.0 | 25 | 0.025 | 85 | Ferrite | 2 | 3.4 | 6.5 |
| | 3 | 1270 | 1040 | 15.0 | 50 | 0.028 | 100 | — | 5 | 2.8 | 7.0 |
| | 4 | 1200 | 900 | 20.0 | 200 | 0.020 | 100 | — | 3 | 2.0 | 8.0 |
| | 5 | 1200 | 920 | 28.0 | 5 | 0.024 | 85 | Martensite | 3 | 2.2 | 7.0 |
| | 6 | 1200 | 900 | 45.0 | 20 | 0.030 | 100 | — | 5 | 2.0 | 7.5 |
| | 7 | 1200 | 900 | 50.0 | 20 | 0.026 | 95 | Martensite | 3 | 2.5 | 7.0 |
| | 8 | 1150 | 900 | 12.0 | 20 | 0.018 | 85 | Ferrite | 2 | 3.0 | 6.5 |
| | 9 | 1200 | 880 | 24.0 | 100 | 0.025 | 90 | Ferrite | 3 | 2.4 | 7.0 |
| | 10 | 1200 | 900 | 45.0 | 300 | 0.028 | 95 | Ferrite | 5 | 1.8 | 7.5 |
| | 11 | 1200 | 900 | 20.0 | 100 | 0.022 | 95 | Ferrite | 3 | 2.1 | 7.5 |
| | 12 | 1200 | 900 | 30.0 | 100 | 0.024 | 100 | — | 3 | 2.2 | 7.5 |
| | 13 | 1180 | 935 | 40.0 | 400 | 0.026 | 80 | Martensite | 5 | 1.9 | 7.0 |
| | 14 | 1200 | 900 | 30.0 | 150 | 0.027 | 85 | Martensite | 2 | 3.5 | 6.5 |
| | 15 | 1200 | 900 | 25.0 | 100 | 0.019 | 95 | Ferrite | 2 | 3.2 | 7.0 |
| | 16 | 1080 | 865 | 8.0 | 30 | 0.029 | 80 | Ferrite | 3 | 3.8 | 6.5 |
| | 17 | 1200 | 900 | 15.0 | 30 | 0.025 | 95 | Ferrite | 3 | 2.4 | 7.5 |

TABLE 3-continued

| No | Heating temp. (° C.) | Finish rolling end temp. (° C.) | Cooling speed V (° C./sec) | Cooling end temp. (° C.) | Δϵ | Bainite area fraction (%) | Residual structure | Outer surface curvature radius R/ thickness t | (211) plane X-ray half width | Low cycle fatigue life (10,000) |
|---|---|---|---|---|---|---|---|---|---|---|
| 18 | 1200 | 900 | 28.0 | 30 | 0.022 | 85 | Martensite | 3 | 2.1 | 7.0 |
| 19 | 1220 | 900 | 50.0 | 30 | 0.023 | 90 | Martensite | 2 | 3.3 | 6.5 |
| 20 | 1200 | 940 | 60.0 | 500 | 0.031 | 100 | — | 5 | 2.7 | 7.5 |
| 21 | 1200 | 900 | 35.0 | 30 | 0.026 | 100 | — | 3 | 2.4 | 8.0 |
| 22 | 1200 | 900 | 25.0 | 30 | 0.024 | 95 | Martensite | 5 | 1.0 | 8.5 |
| 23 | 1200 | 900 | 25.0 | 30 | 0.024 | 100 | — | 3 | 2.2 | 8.0 |
| 24 | 1250 | 870 | 35.0 | 20 | 0.026 | 95 | Ferrite | 3 | 2.4 | 7.5 |
| 25 | 1200 | 900 | 45.0 | 20 | 0.028 | 100 | — | 2 | 4.1 | 6.5 |
| 26 | 1200 | 900 | 12.0 | 100 | 0.022 | 95 | Ferrite | 3 | 2.1 | 7.5 |
| 27 | 1210 | 900 | 12.0 | 450 | 0.020 | 95 | Martensite | 5 | 0.5 | 9.0 |
| 28 | 1200 | 1000 | 7.0 | 20 | 0.020 | 100 | — | 2 | 3.4 | 7.0 |
| 29 | 1200 | 900 | 50.0 | 20 | 0.026 | 95 | Martensite | 3 | 2.2 | 7.5 |
| 30 | 1200 | 900 | 10.0 | 250 | 0.029 | 95 | Martensite | 3 | 4.2 | 6.5 |
| 31 | 1200 | 900 | 45.0 | 100 | 0.032 | 95 | Ferrite | 3 | 3.0 | 7.0 |
| 32 | 1200 | 900 | 45.0 | 100 | 0.040 | 95 | Ferrite | 5 | 3.0 | 7.0 |

TABLE 4

(continuation of Table 3)

| | No. | Heating temp. (° C.) | Finish rolling end temp. (° C.) | Cooling speed V (° C./sec) | Cooling end temp. (° C.) | Δϵ | Bainite area fraction (%) | Residual structure | Outer surface curvature radius R/ thickness t | (211) plane X-ray half width | Low cycle fatigue life (10,000) |
|---|---|---|---|---|---|---|---|---|---|---|---|
| Comp. ex. | 1 | 1200 | 900 | 30.0 | 100 | 0.022 | 80 | Martensite | 3 | 6.1 | 4.0 |
| | 2 | 1200 | 900 | 30.0 | 100 | 0.022 | 85 | Ferrite | 3 | 5.6 | 4.5 |
| | 3 | 1200 | 900 | 100.0 | 100 | 0.022 | 5 | Ferrite | 3 | 7.7 | 0.5 |
| | 4 | 1200 | 900 | 30.0 | 100 | 0.022 | 95 | Ferrite | 3 | 2.4 | 4.0 |
| | 5 | 1200 | 900 | 30.0 | 100 | 0.022 | 95 | Ferrite | 3 | 2.3 | 4.0 |
| | 6 | 1200 | 900 | 30.0 | 100 | 0.022 | 30 | Ferrite | 3 | 6.5 | 1.5 |
| | 7 | 1200 | 900 | 30.0 | 100 | 0.022 | 95 | Ferrite | 3 | 2.7 | 3.5 |
| | 8 | 1200 | 900 | 30.0 | 100 | 0.022 | 60 | Ferrite | 3 | 5.2 | 1.5 |
| | 9 | 1200 | 900 | 35.0 | 150 | 0.022 | 30 | Ferrite | 3 | 6.7 | 4.0 |
| | 10 | 1200 | 900 | 10.0 | 50 | 0.022 | 85 | Ferrite | 1.5 | 6.2 | 1.0 |
| | 11 | 1200 | 900 | 45.0 | 50 | 0.022 | 100 | — | 8 | 1.5 | 8.5 * |
| | 12 | 1200 | 780 | 45.0 | 50 | 0.022 | 70 | Ferrite | 3 | 5.1 | 3.5 |
| | 13 | 1200 | 900 | 100.0 | 100 | 0.022 | 30 | Martensite | 3 | 6.4 | 1.5 |
| | 14 | 1200 | 900 | 4.5 | 50 | 0.022 | 10 | Ferrite | 3 | 7.5 | 0.5 |
| | 15 | 1200 | 900 | 45.0 | 600 | 0.022 | 60 | Ferrite | 3 | 5.8 | 3.0 |
| | 16 | 1200 | 900 | 30.0 | 100 | 0.035 | 80 | Ferrite | 3 | 5.6 | 4.0 |
| | 17 | 1200 | 900 | 30.0 | 100 | 0.048 | 80 | Ferrite | 3 | 7.7 | 1.0 |
| | 18 | 1200 | 900 | 30.0 | 100 | 0.015 | 80 | Ferrite | 3 | Pipemaking not possible | |

Underlines indicate outside suitable range

The area fraction of bainite was found by burying and polishing the cross-section of the plate thickness, then corroding it by a 3% Nital solution, observing the microstructure by an optical microscope by 400×, then quantifying the area rate of the bainite parts. Further, the area fraction was found by a similar method for the remaining structure as well.

The obtained steel plate was formed into a pipe to obtain a ϕ80.0×t2.0 steel pipe. From this steel pipe, an automobile chassis part of an irregular cross-sectional shape which is shown in FIG. 4 was fabricated. Invention Examples 31 and 32 investigated the effects of the dimensions by fabrication of parts of different sizes by similar methods from ϕ60.0×t2.0 steel pipe.

The automobile chassis parts were fabricated by a method similar to the method of production which is shown in PLT 1.

In such parts, if running low cycle fatigue tests after press-formation, it was learned that cracks formed at the portions of the portions 2 where cracks easily occur shown in FIG. 4, so four types of press dies which were changed in radii of curvature R so as to give values of R/t of the portions of the portions 2 where cracks easily occur become 2, 3, 5, and 10 were prepared to fabricate automobile chassis parts.

The values of R/t of the examples show which of the four types of dies were used for the press-forming. Note that the portion 2 which easily cracks is the portion with the smallest R/t in the part even if changing R/t to 2 to 10 in range, so the portion where cracks easily form at the time of running a low cycle fatigue test may be considered to be this position.

The value of Δϵ was found by the above-mentioned method.

Further, the value of the X-ray half width was found by chemically polishing the portion 2 where cracks easily occur in the obtained automobile chassis part, then measuring the value in that state. For the apparatus, an X-ray stress analyzer Model PSPC-MSF made by Rigaku was used. The measurement was performed by the parallel slant method. The measurement conditions were as follows:

Target: Cr—Kα/V filter

Tube voltage/tube current: 40 kV/30 mA

Counter: position sensitive type proportional counter tube

Collimator: 0.5 mmϕ

Diffraction plane, interplanar distance: (211), d=1.1702 Å

The low cycle fatigue characteristic was evaluated by the fatigue life when performing a fatigue test which twists the part as a whole under conditions giving a stress amplitude/TS of the portion 2 where cracks easily occur of 0.8. The frequency of the fatigue test was 1 Hz and the stress conditions were complete reversed bending.

The criteria for judgment as being "good" was made a fatigue life of 60,000 cycles.

Tables 3 and 4 show the result of the low cycle fatigue test.

The automobile chassis parts of the invention examples have steel materials which form the parts which have uniform structures where at least 80% of the microstructure is comprised of bainite. Further, the $\Delta\epsilon$ is within the range of the present invention, so there are few voids or other defects introduced at the time of making the pipes. Further, even if the ratio R/t of the thickness "t" of the portion which forms the starting point of low cycle fatigue cracks of the part after shaping and the external surface curvature radius R is 5 or less, the X-ray half width of the portion which forms the starting point of fatigue cracks is small and there are few voids or other defects even after the part is formed. Further, the structure is a uniform one where at least 80% of the microstructure is comprised of bainite, so the fatigue damage does not become localized. Furthermore, for a high stress amplitude in the low cycle fatigue region, the yield is higher than a structure such as DP steel and the slip resistance of dislocations with respect to repeated stress is high. Therefore, the low cycle fatigue characteristics of the automobile chassis parts of the invention examples were good.

As opposed to this, in the comparative examples which deviate from the scope of the present invention, the low cycle fatigue characteristics were not excellent.

Comparative Example 1 had a large amount of C of the steel material which forms the part, so the low cycle fatigue characteristics were not excellent. This is believed because the number of carbides increased, micro voids easily formed at the interface of the carbides, further, the strength became too high, and as a result a large number of voids and other defects formed at the time of pipemaking and shaping.

Comparative Example 2 had a large amount of Si, so the low cycle fatigue characteristics were not excellent. This is believed because formation of $SiO_2$ and other inclusions was invited and a large number of micro voids were formed at the time of shaping.

Comparative Example 3 had a small amount of Mn, so the low cycle fatigue characteristics were not excellent. This is believed because the quenchability was insufficient, a sufficient bainite fraction was not obtained, the structure became mainly ferrite and not suitable for bending, and as a result a large number of micro voids were formed at the time of shaping.

Comparative Example 4 had a large amount of P, so the low cycle fatigue characteristics were not excellent. This is believed to be because P concentrated at the crystal grain boundaries and caused a drop in the fatigue strength of the grain boundaries.

Comparative Example 5 had a large amount of S, so the low cycle fatigue characteristics were not excellent. This is believed because coarse MnS was formed and caused deterioration of the fatigue characteristics.

Comparative Example 6 had a small amount of Ti, so the low cycle fatigue characteristics were not excellent. This is believed because since the amount of Ti was insufficient, N could not be immobilized as TiN and ended up precipitating as BN, so the effect of improvement of the quenchability by B could not be exhibited, a sufficient bainite fraction could not be obtained, and the structure became mainly ferrite and not suitable for bending, so a large number of micro voids were formed at the time of shaping.

Comparative Example 7 had a large amount of Al, so the low cycle fatigue characteristics were not excellent. This is believed because coarse AlN was formed and degraded the fatigue characteristics.

Comparative Example 8 had a large amount of N, so the low cycle fatigue characteristics were not excellent. This is believed because coarse AlN was formed and thereby the fatigue characteristics were degraded, furthermore BN was formed and the effect of improvement of the quenchability of B could not be exhibited, a sufficient bainite fraction could not be obtained, and the structure became mainly ferrite and not suitable for bending, so a large number of micro voids were formed at the time of shaping.

Comparative Example 9 had a small amount of B, so the low cycle fatigue characteristics were not excellent. This is believed because the effect of improvement of the quenchability of B could not be exhibited, a sufficient bainite fraction could not be obtained, and the structure became mainly ferrite and not suitable for bending, so a large number of micro voids were formed at the time of shaping.

Comparative Example 10 had a value of the X-ray half width of the (211) plane larger than the scope which is defined by the present invention, so the low cycle fatigue characteristics were not excellent. This is believed because the value of R/t was a small 1.5, so a large number of micro voids were formed at the time of shaping to a part.

Comparative Example 11 had a value of R/t of a large 8. The low cycle fatigue life was a sufficient life of 85,000 cycles. In the range of a large R/t and small shaping strain, the number of micro voids which were formed at the time of shaping was small, so naturally the low cycle fatigue characteristics were excellent.

As shown in FIG. 2, in the range of a large R/t, it is believed that sufficient low cycle fatigue characteristics are exhibited not only in the present invention part, but in the conventional part as well. In this way in the range of a large R/t, sufficient low cycle fatigue characteristics are obtained even if using a conventional part.

In the range of a small R/t, with conventional parts, sufficient low cycle fatigue characteristics cannot be obtained, but with the present invention part, sufficient low cycle fatigue characteristics can be obtained, so according to the present invention, the design freedom of the part is broadened.

In Comparative Examples 12, 13, 14, and 15, the hot rolling conditions of the steel members which form the part are outside the scope of the present invention, so the low cycle fatigue characteristics are superior. This is believed to be because a sufficient bainite fraction could not be obtained, so a large number of micro voids were formed at the time of shaping.

In Comparative Examples 16 and 17, the pipemaking strain $\Delta\epsilon$ of the outermost surface of the steel material which is introduced in the BD process is larger than the definition of the present invention and a large number of voids and other defects are introduced at the time of pipemaking, so the value of the X-ray half width did not satisfy the definition of the present invention and the low cycle fatigue characteristic was not excellent.

In Comparative Example 18, the pipemaking strain $\Delta\epsilon$ of the surface of the steel material which is introduced in the BD process is smaller than the range which is defined in the present invention, the bending was insufficient, and shaping into a pipe was not possible. Therefore, this was not subsequently evaluated.

Above, examples were used to explain the present invention, but the present invention is not limited to these. Further, the present invention is art which is applicable to not only automobile chassis parts, but also other fields such as automobile pillars, railroads, cylinders, etc. so long as satisfying the conditions of the present invention.

INDUSTRIAL APPLICABILITY

According to the present invention, it is possible to produce automobile chassis parts which have low cycle fatigue characteristics which are far superior to automobile chassis parts which are produced by other methods of production, so it is possible to omit the hardening after shaping, strengthening, and other heat treatment.

Due to the omission of the heat treatment, reduction of the cost of the heat treatment is possible and, further, deposition of oxide scale at the time of heat treatment can be prevented, so it is possible to prevent degradation of the quality of appearance of the part and furthermore prevent changes in shape due to heat treatment, so the industrial applicability is large.

REFERENCE SIGNS LIST

1 Electric resistance weld zone
2 Portion which easily cracks (due to low cycle fatigue)

The invention claimed is:

1. An automobile chassis part which is excellent in low cycle fatigue characteristics comprising a steel which contains, by mass %,
C: 0.02 to 0.10%,
Si: 0.05 to 1.0%,
Mn: 0.3 to 2.5%,
P: 0.03% or less,
S: 0.01% or less,
Ti: 0.005 to 0.1%,
Al: 0.005 to 0.1%,
N: 0.0005 to 0.006%, and
B: 0.0001 to 0.01 and
has a balance of Fe and unavoidable impurities,
wherein the automobile chassis part has a portion having a ratio of external surface curvature radius R/thickness t of 5 or less,
wherein the automobile chassis part which is excellent in low cycle fatigue characteristics has 80% or more of the part structure being a bainite structure, and
wherein the portion has an X-ray half width of an (211) plane of 5 (deg) or less.

2. The automobile chassis part which is excellent in low cycle fatigue characteristics as set forth in claim 1, wherein the steel which forms said automobile chassis part further contains, by mass %, one or more elements which are selected from
Cu: 0.005 to 1.0%,
Ni: 0.005 to 1.0%,
Cr: 0.03 to 1.0%,
Mo: 0.1 to 0.5%,
Nb: 0.003 to 0.2%,
V: 0.001 to 0.2%,
W: 0.001 to 0.1%,
Ca: 0.0001 to 0.02%,
Mg: 0.0001 to 0.02%,
Zr: 0.0001 to 0.02%, and
REM: 0.0001 to 0.02%.

3. A method of production of the automobile chassis part which is excellent in low cycle fatigue characteristics according to claim 1, the method comprising heating a steel slab which contains, by mass %,
C: 0.02 to 0.10%,
Si: 0.05 to 1.0%,
Mn: 0.3 to 2.5%,
P: 0.03% or less,
S: 0.01% or less,
Ti: 0.005 to 0.1%,
Al: 0.005 to 0.1%,
N: 0.0005 to 0.006%, and
B: 0.0001 to 0.01%
and has a balance of Fe and unavoidable impurities,
to 1070° C. to 1300° C., then
hot rolling by a finish rolling end temperature of 850° C. to 1070° C., then
cooling by a cooling speed V (° C./sec) which satisfies formula (A) down to 500° C. or less, then
forming a pipe so that a pipemaking strain $\Delta\epsilon$ of an outermost surface of the steel material in a breakdown process becomes a range of the following formula (B) at the time of an outside diameter D and a thickness "t", then
press-forming the pipe:

$$300/M \leq V \leq 3000/M \quad \text{(A)}$$

$$0.7t/(D-t) \leq \Delta\epsilon \leq 1.2t/(D-t) \quad \text{(B)}$$

$$\text{where, } M = \exp\{6.2(C+0.27Mn+0.2Cr+0.05Cu+0.11Ni+0.25Mo)+0.74\} \quad \text{(C)}$$

the values of C, Mn, Cr, Cu, Ni, and Mo of formula (C) are mass %.

4. A method of production of the automobile chassis part which is excellent in low cycle fatigue characteristics according to claim 2, the method comprising heating a steel slab which contains, by mass %,
C: 0.02-0.10%,
Si: 0.05 to 1.0%,
Mn: 0.3 to 2.5%,
P: 0.03% or less,
S: 0.01 or less,
Ti: 0.005 to 0.1%,
Al: 0.005 to 0.1%,
N: 0.0005 to 0.006%,
B: 0.0001 to 0.01%, and
one or more elements which are selected from
Cu: 0.005 to 1.0%
Ni: 0.005 to 1.0%
Cr: 0.03 to 1.0%
Mo: 0.1 to 0.5%
Nb: 0.003 to 0.2%,
V: 0.001 to 0.2%,
W: 0.001 to 0.1%,
Ca: 0.0001-0.02%,
Mg: 0.0001-0.02%,
Zr: 0.0001 to 0.02%,
REM: 0.0001 to 0.02%,
and has a balance of Fe and unavoidable impurities,
to 1070° C. to 1300° C., then
hot rolling by a finish rolling end temperature of 850° C. to 1070° C., then
cooling by a cooling speed V (° C./sec) which satisfies formula (A) down to 500° C. less,
forming a pipe so that a pipemaking strain $\Delta\epsilon$ of an outermost surface of the steel material in a breakdown process becomes a range of the following formula (B) at the time of an outside diameter D and a thickness "t", then press-forming the pipe:

$$300/M \leq V \leq 3000/M \quad \text{(A)}$$

$$0.7t/(D-t) \leq \Delta\epsilon \leq 1.2t/(D-t) \quad \text{(B)}$$

$$\text{where, } M = \exp\{6.2(C+0.27Mn+0.2Cr+0.05Cu+0.11Ni+0.25Mo)+0.74\} \quad \text{(C)}$$

the values of C, Mn, Cr, Cu, Ni, and Mo of formula (C) are mass %.

* * * * *